US006434800B1

(12) United States Patent
James et al.

(10) Patent No.: US 6,434,800 B1
(45) Date of Patent: Aug. 20, 2002

(54) GOLF CLUB COVER RETAINING DEVICE

(76) Inventors: Carolyn J. James, 9632 S. Vandalia, Tulsa, OK (US) 74137; Sherri J. Goodall, 7512 S. Gary Pl., Tulsa, OK (US) 74136

( * ) Notice: Subject to any disclaimer, the term of this patent is extended or adjusted under 35 U.S.C. 154(b) by 0 days.

(21) Appl. No.: 09/742,156

(22) Filed: Dec. 20, 2000

(51) Int. Cl.[7] ..... A63B 57/00
(52) U.S. Cl. ..... 24/298; 24/300
(58) Field of Search ..... 150/159, 160; 206/315.3, 315.4; 24/298, 300–302

(56) References Cited

U.S. PATENT DOCUMENTS

| | | | | | |
|---|---|---|---|---|---|
| 452,830 | A | | 5/1891 | Bowie | |
| 1,957,577 | A | | 5/1934 | Chapman | 150/1.5 |
| 2,563,698 | A | | 8/1951 | Whitebread | 65/54 |
| 2,994,300 | A | | 8/1961 | Grahling | 119/96 |
| 3,460,207 | A | | 8/1969 | Stewart | 24/73 |
| 3,657,774 | A | | 4/1972 | Reynolds | 24/73 CF |
| 3,747,654 | A | * | 7/1973 | Wilson | 206/315.3 |
| 3,967,667 | A | | 7/1976 | Robinson | 150/1.5 R |
| D243,353 | S | | 2/1977 | Edwards | D34/5 GB |
| 4,126,166 | A | | 11/1978 | Hohenstein | 150/1.5 R |
| 4,296,787 | A | | 10/1981 | Barton | 150/52 G |
| 4,361,934 | A | * | 12/1982 | Darnell | 24/302 |
| D278,456 | S | | 4/1985 | Lewis | D22/13 |
| 4,625,862 | A | | 12/1986 | Clayton | 206/315.3 |
| 4,830,248 | A | | 5/1989 | Pommenville | 224/269 |
| 5,025,843 | A | | 6/1991 | Caufield | 150/160 |
| 5,246,108 | A | | 9/1993 | Nusbaum | 206/315.2 |
| 5,345,987 | A | | 9/1994 | Hagar | 150/160 |
| 5,586,674 | A | | 12/1996 | Nachbauer | 206/315.4 |
| 5,722,125 | A | | 3/1998 | Vasilopoulos | 24/301 |
| 5,815,977 | A | * | 10/1998 | Hill, Jr. | 43/25 |
| 5,864,925 | A | | 2/1999 | McGee | 24/3.11 |
| 5,870,023 | A | | 2/1999 | Jackson | 340/568 |
| 5,901,930 | A | * | 5/1999 | Harrel | 224/222 |
| 6,076,668 | A | | 6/2000 | Keane et al. | 206/315.4 |

* cited by examiner

*Primary Examiner*—James R. Brittain
(74) *Attorney, Agent, or Firm*—Head, Johnson & Kachigian

(57) ABSTRACT

An improved golf club cover retaining device to secure golf club head covers to a golf bag which includes a golf bag securing mechanism circumferentially positioned and affixed to the generally upper portion of the golf bag, a securing mechanism affixation means attaching opposite ends of the securing mechanism for removably attaching the device to the golf bag; at least one generally elongate golf club retainer cord having a proximal end zone, a distal end zone, and a central zone extending between the proximal and distal end zones; a double swivel inter-connector means on the proximal end zone of the cord for securing the cord to the golf bag securing mechanism in movable relation thereto so that the inter-connector means and the cord are able to travel circumferentially around the golfbag; and a golf club cover connector means on the distal end zones of the cord for removable attachment of the head covers.

9 Claims, 1 Drawing Sheet

GOLF CLUB COVER RETAINING DEVICE

BACKGROUND OF THE INVENTION

1. Field of the Invention.

The present invention relates to securing means for golf club head covers. More particularly, the invention relates to an improved golf club cover retaining device in which each head cover is secured independently of the other in a manner to greatly minimize or eliminate tangling of cords attached to said independently connected golf club covers.

2. Prior Art.

Securing devices for golf club covers are well known and represented in the prior art. For example:

U.S. Pat. No. 3,967,667 issued on Jul. 6, 1976 to Joseph J. Robinson discloses a golf club cover-holder construction which consists of four tubular plastic members that are adapted to be placed within a golf bag for individually holding and protecting the golf club woods. The tubular members are secured together in a clustered, abutting parallel relationship for receiving golf clubs through open top ends of the tubular members. A longitudinally extending side opening is formed in each of the tubular members and communicates with the open top end and terminates in a lower cutout region formed in the tubular member. The side openings form a pair of flaps in each of the tubular members which extend between the top end and cutout region, which flaps are integral portions of the tubular members. The flaps grip and partially conform to the head of a gold club due to the resiliency and elasticity of the plastic material to retain the club within the tube and to prevent it from contacting adjacent club heads.

U.S. Pat. No. 4,126,166 issued on Nov. 21, 1989 to George Hohenstein discloses a securing apparatus for golf head covers. The '166 patent is an apparatus for protectively securing golf head covers to a golf bag to prevent loss or damage of head covers. A plurality of grommets are disposed in uniform spaced relation about the upper periphery of a golf bag. A like plurality of flexible members has first ends thereof attached to a corresponding grommet, and second ends thereof attached to the ring means commonly on the upper surfaces of golfhead covers. In two embodiments of this invention the grommets are disposed along a strap member adapted to be attached to a golf bag at the divider strap attachment point commonly provided on golf bags. In one of these, the strap member is provided with clips or snap fasteners for attachment to the portion of the club divider strap located on the exterior surface of the golf bag; in the other, the strap member of this invention is passed through the club divider strap grommets and its ends are connected to encircle the portion of the peripheral surface of the golf bag between the club divider strap grommets. In other embodiments of this invention the flexible members are attached to grommets disposed directly through the golf bag itself, or to grommets disposed through the club divider strap within the golf bag. As clearly distinguished from the instant invention, the '166 invention does not use a flexible cord to attach to the golf bag. It uses a stable belt that is secured to the golf bag through existing grommets in the golf bag. Flexible straight cords are used rather than curly cords which are then run through the belt grommets. These cords are attached with a ring made of metal or plastic to golf club covers that already have loop or around a yarn tassel. The instant invention attaches to the head covers with an alligator clip.

U.S. Pat. No. 4,296,787 issued on Oct. 27, 1981 to C.D. Barton discloses a connection device for golf club head covers wherein an elongated flexible cord cooperates with a plurality of coil springs to interconnect golf club head covers. The cord is passed through eyelets attached to the head covers. The coil springs are sleeved over the cord and extend between adjacent eyelets to resist tangling of the cord while permitting it to bend as the head covers are removed and replaced on the club heads.

U.S. Pat. No. 4,625,862 issued on Dec. 2, 1986 to Gene Clayton discloses a support assembly for use with golf bags, belts, garment loops and the like comprising a first component having a Velcro section, said component being suspended from said golf bag or other article, a second component carrying a Velcro section adapted for interengagement with the Velcro section on the first component, said second component being engaged to a frequently used accessory whereby the latter is maintained against loss during disuse by engagement of the Velcro sections on said first and second components.

U.S. Pat. No. 4,830,248 issued on May 16, 1989 to Robert A. Pommenville discloses a device for attachment to a golf bag and for holding golf accessory articles, such as a score card, pencil, golf tees and the like, including a first clip member having opposed legs integrally joined at an end thereof, one of the legs defining a spring element for frictionally mounting the first clip member over an edge of the golf bag, wherein the legs of the first clip member engage inner and outer surfaces of the golf bag to securely mount the device in place thereon. A second clip member is integrally joined to the first clip member and includes an inner leg that is connected to a leg of the first clip member and is disposed in substantially face-to-face relation therewith but is pivotal relative thereto for accommodating a score card in removable relation between. The second clip member includes another leg that is integrally joined to the inner leg of the second clip member by an upper curved portion, the last named leg of the second clip member having an outer portion that normally is urged into engaging relation with the adjacent surface of the inner leg of the second clip member, openings being formed in the upper curved portion that joins the legs of the second clip member for receiving other accessory articles therein, such as a pencil and golf tee.

U.S. Pat. No. 5,025,843 issued on Jun. 25, 1991 to Cavitt Caufield discloses a golf club head cover keeper that keeps head covers from being lost during a round of golf. The keeper is made to resemble a golf ball. The golf ball is divided into two halves that are joined together with magnets. The ends of each are connected to head covers through snap rings. When the cover is removed from the club it and the keeper are simply attached to another magnetized sphere half and the covers are thereby kept together.

U.S. Pat. No. 5,109,578 issued on May 5, 1992 to Carolee M. Cox discloses a hand-sized golf club cover retention apparatus or connector is disclosed. The apparatus comprises a connector body to which there is attached golf bag connector means, such as a side clip or snap, and a plurality of flexible cords. The cords include movable loop securement means, such as card locks, which define a loop therein. The size of the loop and its distance from the connector body are both adjustable by means of the loop securement means.

U.S. Pat. No. 5,246,108 issued on Sep. 21, 1993 to Robert O. Nusbaum discloses a golf club cover support formed from an elongated member shaped to define the perimeter of a head portion and a shaft portion. The shaft portion including a pair of generally parallel support portions adapted to be disposed at opposite sides of the wall of a golf bag with the support portions spanned by a clamping member permitting the support portions to be pressed towards each other against the walls of the golf bag to support the head portion in a position above the opening of the bag to receive and temporarily support the cover of a golf club.

U.S. Pat. No. 5,586,674 issued on Dec. 24, 1996 to Armand E. Nachbauer discloses a golf club cover device for semi-permanent attachment to a golf bag serves the purpose of promptly alerting a golfer to a missing golf club, particularly an iron. The device comprises a receiving member and an L-shaped meshing member. The receiving member has a main body with a passageway extending through it and a vertical hooking leg extending along one side. In use, the vertical hooking leg extends over an open-top edge of the golf bag and helps to hold the receiving member in place. A substantially horizontal leg of the L-shaped meshing member is configured to fit in the passageway of the receiving member for limited rotational movement. A protuberance on an enlarged terminus of the horizontal leg of the L-shaped member is used to engage a sidewall of the golf bag. A substantially vertical leg on the meshing member is used to hold the club cover. In use, the L-shaped meshing member rocks from a non-locking position to a locking position whereby the protuberance is forced into contact with the golf bag. Any club cover placed on the vertical leg of the L-shaped meshing member is prominent. The golfer has to merely glance at his golf bag and, if the club cover is still in place, realize that his golf club needs to be retrieved.

U.S. Pat. No. 5,722,125 issued on Mar. 3, 1998 to Peter Vasilopoulos discloses a securing device for golf club head covers which includes a base ring member, a clip fitted to the base ring, and being structured for removable attachment to the golf bag, one or more elastomeric cords having a proximal end secured to the base ring with a swivel fitting and a distal end zone including a hook element fitted thereto with a swivel fitting for removable attachment of the cord to a respective one of the head covers, wherein the head covers, when removed from corresponding golf clubs, remain interconnected to the device and the golf bag so that they do not become separated therefrom and possibly misplaced or lost. One or more alligator clips or like fittings may be provided on the base ring for hanging a hat, glove, or other article therefrom. As clearly distinguished from the '125 invention, the instant invention attaches directly to a golf bag with a straight stretchable cord fastened around the circumference of the bag with 2 J-hook, or similarly intended clips. This avoids further cluttering the bag where towels, club scrubbers, bag tags, etc. are usually attached. Additionally curly cords are attached to the stretchy cord by use of a lobster claw clip. A stretchable curly cord can then be attached to a golf club cover with an alligator clip. Using curly cord avoids the tangling that is normally experienced with using any kind of straight or elastic cord, chain, wire, etc. The alligator clip pinches the golf club cover to hold it rather than piercing the fabric of the cover.

U.S. Pat. No. 5,864,925 issued on Feb. 2, 1999 to Robert Wayne McGee discloses a golf glove attachment device wherein a thin plastic card, with passive and aggressive Velcro patches on the front and back, is connected to a spring-loaded reel mechanism which contains a retractable cord. Said reel mechanism is attached to the person as evidenced in FIGS. 1 and 3. The plastic card is then extended by pulling on the retractable cord of the reel mechanism. When fully extended, and passive and aggressive Velcro on the glove is mated and attached to the corresponding passive and aggressive Velcro on the plastic card. Once secured, the golf glove is returned to its resting position on the hip.

U.S. Pat. No. 6,076,668 issued on Jun. 20, 2000 to Vincent Keane and Douglas Young discloses a golf head cover organizer which attaches to the upper exterior of a golf bag and is used to secure golf club covers and the golf clubs therein in the vicinity of the top of the golf bag so that the user can have ready access. The '668 invention discloses a device which has multiple spring-loaded tensioning lines which lines are connected by connectors to the top of the individual golf club covers. The lines are lockably extendible and retractable having clip-like fasteners which can be attached to the top of the golf club covers so as to secure the golf club cover in close proximity to the top of the golf bag. The housing of the '668 device is attached to the golf bag by a belt. An alternative embodiment of the '668 device is disclosed wherein the housing is molded into the golf bag. As clearly distinguished from the '668 invention, the present disclosure does not use or require any such spring loaded tension lines. The lines connected directly to head covers are curly stretch cords to prevent tangling of the cords. No housing device is necessary for use with the present invention. The present invention does not include golf club covers and are easily attached to any type of golf club cover as there are many different types of golf club covers in today's use. It is also not necessary to have a loop in the closed portion of the cover.

As evidenced by the discussion of the preceding prior art, it is clear that a golf club cover retaining device intended to minimize a likelihood of tangling of attached golf club covers once said covers have been disassociated with golf clubs remains unaddressed and is long overdue. Given the design, teachings, claims and disclosures of the afore noted prior art, the present invention addresses this inadequacy by presenting a robust article of manufacture which allows for independent movement of a secure golf club cover around the circumference of a golf bag. Such movement or travel allows positioning of golf club cover retaining devices in such a manner so as to preclude their engagement and tangling. It is therefore a goal of the present invention to provide a golf club cover retaining device which minimizes the potential for intermingling and tangling with other golf club cover retaining devices attached to a golf bag.

It is a further object of the instant invention to provide ease of use and independent positioning of individual golf club covers and their retaining mechanisms.

It is yet a further object of the instant invention to provide an improved golf club cover retaining device which utilizes a coil-like elastomeric material to allow such a retained device to be stretched from a relaxed length to an extended length under tension.

It is yet another object of the instant invention to provide a golf bag securing mechanism formed of an elastomeric material which allows the mechanism to be stretched from a relaxed length to an extended length under tension.

Yet another object of the instant invention is to provide a golf club cover retaining device which utilizes a double swivel interconnector means to allow a spinning of a golf club cover without imparting a twist to a securing mechanism attached to said cover.

Other objects and further scope of the applicability of the present invention will become apparent from the detailed description to follow, taken in conjunction with the accompanying drawings wherein like parts are designated by like reference numerals.

SUMMARY OF THE INVENTION

The present invention provides for an improved golf club cover retaining device which allows for the independent suspension and positioning of individual golf club covers while minimizing the potential for the inadvertent tangling of multiple covers so attached. The present invention provides for such capability by teaching an improved golf club cover retaining device comprised of a golf bag securing mechanism circumferentially positioned and affixed to the generally upper portion of the golf bag; a securing mechanism affixation means attached to opposite ends of the securing mechanism for removably attaching the device to the golf bag; at least one generally elongate golf club retainer cord having a proximal end zone, a distal end zone, and a central zone extending between the proximal and distal end zones; a double swivel inter-connector means on the proximal end zone of the cord for securing the cord to the golf bag securing mechanism in movable relation thereto so that the inter-connector means and the cord are able to travel circumferentially around the golf bag; and a golfclub cover connector means on the distal end zones of the cord for removable attachment of the head covers.

LIST OF REFERENCE NUMERALS

Figure 1:
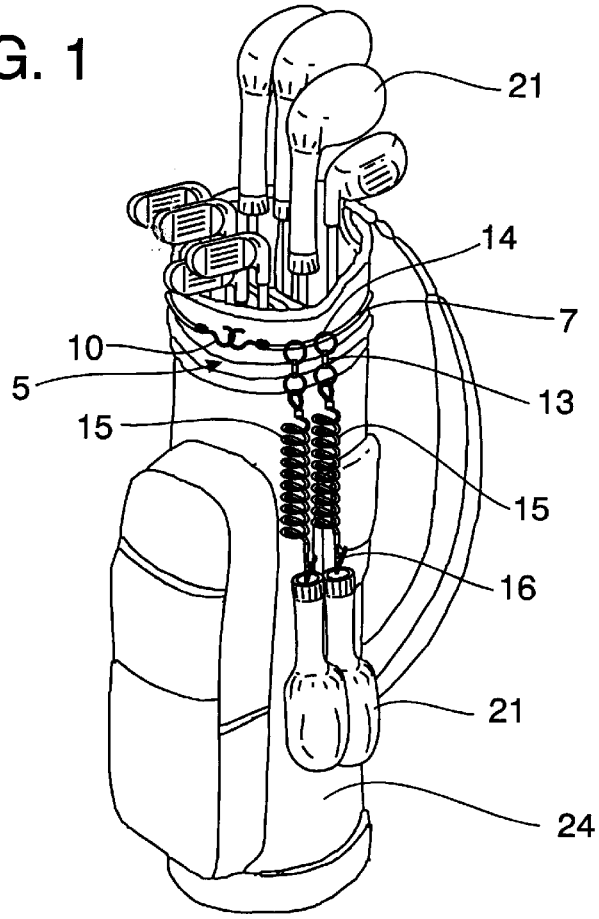
FIG. 1 illustrates the invention as practiced in its preferred embodiment as positioned on an existing golf bag and further illustrating golf club cover detail.

With regard to the numerals used herein, the following numbering scheme is used throughout the application's figures.

05 present invention
07 golf bag securing mechanism
10 securing mechanism affixation means
13 double swivel inter-connector
14 double swivel ring
15 golf club cover retaining cord
16 golf club cover connector means
19 golf club cover connector
21 golf club cover
24 golf bag

DETAILED DESCRIPTION OF THE PREFERRED EMBODIMENTS

Figure 2:
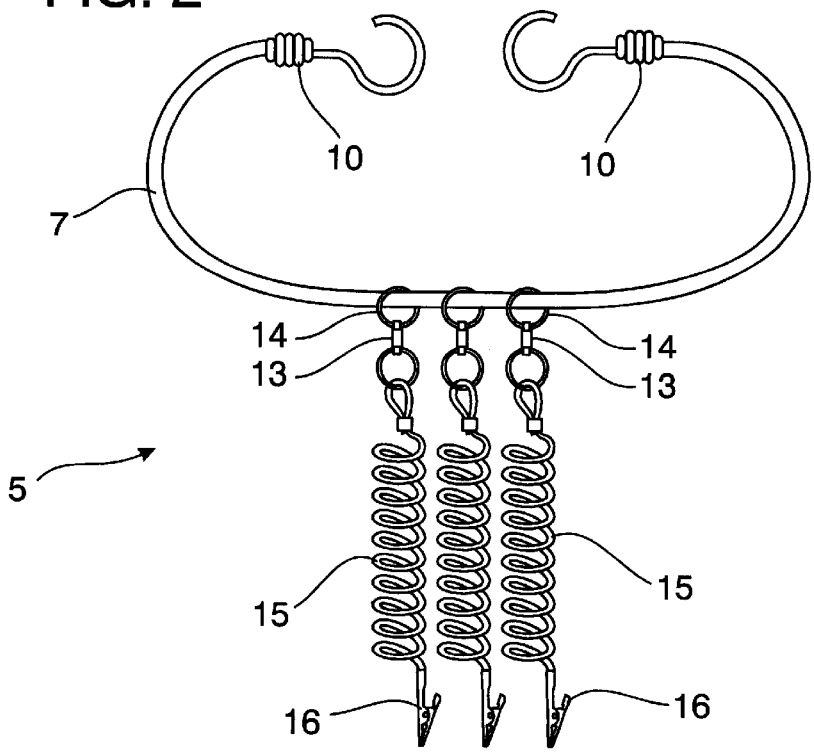
FIG. 2 illustrates the invention as practiced in its preferred embodiment.

The invention is best understood with respect to its practice, structural components in association with the discussion of FIGS. 1 and 2. Referring to the drawings in detail, FIGS. 1 and 2 illustrate the improved golf club cover retaining device of the instant invention and said device as positioned on an existing golf bag further illustrating golf club cover detail. A golf bag securing mechanism 07 is a measured stretchable construction intended to be positioned around the outside diameter of a golf bag generally positioned along the golf bag's uppermost region. In the invention's preferred embodiment the golf bag securing mechanism 07 is constructed of a non-coiled "bungee cord" type material and is approximately 24 inches in length. Though it is easily envisioned that a non-bungee cord type of composition may be substituted to construct the golf bag securing mechanism 07. At opposite ends of the golf bag securing mechanism is the invention's securing mechanism affixation means 10. Without limitation, such means would include J-hook apparatuses embodying a sleeve/collar combination which attaches to the opposite ends of the golf bag securing mechanisms 07. Through practice it has been found that sleeve/collar J-hook combinations most effectively allow for the proper positioning of the golf bag securing mechanism around the outside diameter of the golf bag 24. A double swivel interconnector ring 13 attaches a golf club cover retaining cord 15 to the golf bag securing mechanism 07. The double swivel ring 14 of the double swivel interconnector 13 allows for positioning of the invention's golf club cover retainer cord 15 any where along the continuum represented as the golf club bag securing mechanism 07. Such flexible and independent positioning of such golf club cover retainer cord 15 allow for greatly minimizing the potential of the intermingling of multiple cords 15 when one or more golf club covers 21 have been removed from their respective golf clubs and left to dangle along the periphery of the golf bag 24. In the invention's preferred embodiment, the golf club cover retaining cord 15 is constructed of a curly bungee-type material approximately 4 inches in length. Though it is easily envisioned that any coil-like expandable structure typically comprised of elastomeric material would easily serve as an alternative construction to facilitate the purposes of the instant invention. At the distal end of the golf club cover retainer cord 15 a clip like apparatus 16 capable of pinching or piercing a golf club cover is attached to the golf club cover retainer cord 15. In the invention's preferred embodiment, clips referred to as lobster or alligator clips have been utilized and found to effectively allow for the practice of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved golf club cover retaining device for use on a golf bag having a plurality of golf clubs therein and head covers on at least some of the golf clubs, said device comprising:

a golf bag securing mechanism in direct contact with the outermost surface of a golf bag and circumferentially positioned and affixed to the generally upper portion of said golf bag;

a securing mechanism affixation means attached to opposite ends of said securing mechanism for removably attaching said device to said golf bag;

at least one generally elongate golfclub cover retainer cord having a proximal end zone, a distal end zone, and a central zone extending between said proximal and distal end zones;

a double swivel inter-connector means on said proximal end zone of said cord for securing said cord to said golf bag securing mechanism in movable relation thereto so that said inter-connector means and said cord are able to travel circumferentially around said golf bag; and a golf club cover connector means on said distal end zones of said cord for removable attachment of said head covers.

2. A device as recited in claim 1 wherein said golf bag securing mechanism is formed of an elastomeric material allowing said mechanism to be stretched from a relaxed length to an extended length under tension.

3. A device as recited in claim 1 wherein said cord is formed of an elastomeric material allowing said cord to be stretched from a relaxed length to an extended length under tension.

4. A device as recited in claim 1 wherein said double swivel inter-connector means on said proximal end zones of said cord includes swivel means to allow said cord to spin relative to said securing mechanism without imparting a twist to said cord.

5. A device as recited in claim 1 wherein said golf club cover connector means is an alligator clip.

6. A device as recited in claim 1 wherein said golf club cover connector means is removably attachable to head covers on golf clubs including woods, irons, and putters.

7. A device as recited in claim 1 wherein said securing mechanism is of elastomeric construction.

8. A device as recited in claim 1 wherein said golf club retainer cord is of elastomeric coiled construction.

9. A device as recited in claim 1 wherein said device further comprises a plurality of golf club retainer cords.

* * * * *